United States Patent [19]

James

[11] Patent Number: 4,588,155

[45] Date of Patent: May 13, 1986

[54] SUPPORTS FOR HOISTS

[75] Inventor: David R. James, Tirley, England

[73] Assignee: James Industries Limited, Gloucester, England

[21] Appl. No.: 531,911

[22] Filed: Sep. 12, 1983

[30] Foreign Application Priority Data

Sep. 14, 1982 [GB] United Kingdom ..... 8226132

[51] Int. Cl.[4] ..... A47H 1/10

[52] U.S. Cl. ..... 248/205.1; 4/496; 4/504; 4/511; 5/83; 248/205.5

[58] Field of Search ..... 248/205.1, 205.5, 206.1, 248/213.2, 215; 5/83, 84, 88; 4/496, 504, 511

[56] References Cited

U.S. PATENT DOCUMENTS

| | | | |
|---|---|---|---|
| 3,289,217 | 12/1966 | Glover | 5/83 |
| 3,996,632 | 6/1975 | Bakker nee Viel | 5/83 |
| 4,283,803 | 8/1981 | Krumbeck | 4/496 |
| 4,399,572 | 8/1983 | Johansson | 5/83 |
| 4,432,522 | 2/1984 | Pruente et al. | 248/215 |

*Primary Examiner*—Ramon S. Britts
*Assistant Examiner*—Ramon O. Ramirez
*Attorney, Agent, or Firm*—Collard, Roe & Galgano

[57] ABSTRACT

A support structure for a hydrotherapy hoist or pool lift comprises a U-shaped upper portion which extends over the decking at a side edge of the pool, and a lower portion welded to the intermediate limb of the upper U and extending down into the pool. The upper portion engages an upper anchorage at each side limb of the U, and a reaction pad at the lower end of the lower portion bears against the side wall of the pool. The hoist has a vertical column from which a short cantilever lifting arm projects, a patient support seat being mounted on the arm. A lifting mechanism is operable to raise and lower the arm and seat. The hoist is detachably supported by means of pintle-type bearings mounted, respectively, adjacent the upper and lower ends of the lower support portion with offset bearing pins on the column engaging in bearing blocks welded to the support. The bearings allow the hoist to be swung through 180° about a vertical axis between a loading position, with the seat above the decking, and a treatment position in which the seat and a supported patient can be lowered into the pool.

9 Claims, 8 Drawing Figures

SUPPORTS FOR HOISTS

BACKGROUND OF THE INVENTION

1. Field of the Invention

This invention relates to supports for hoists for handling invalids and the disabled, and in particular to supports for so-called hydrotherapy hoists or pool lifts and the resultant hoist/support combinations. Such hoists are used to lift patients into and out of a hydrotherapy pool for treatment therein, and they are commonly also used to provide pool access for physically handicapped swimmers.

The invention is more particularly, but not exclusively, concerned with hoists which comprise an upstanding lifting column at the side of which there is supported a patient support member, of seat or stretcher form, with the column in use being mounted adjacent the edge of the pool. In addition to raising and lowering movement under the control of a lifting mechanism within or associated with the column, the patient support member of such a hoist can be swung around from a loading position at the side of a pool to a position above the pool for lowering into the latter.

2. Description of the Prior Art

Hoists (of the foregoing character) are often used in public swimming baths, when it is usually a requirement that they are readily removable when not in use and that any hoist support structure which is used should either be removable or provide negligible obstruction when the hoist itself is removed and stored out of the way. The support for such a hoist is normally provided by a floor mounting plate or socket fixed to or into the pool decking some distance from the edge of the pool. In order to provide firm fixings the mounting cannot be close to the edge and thus often presents a considerable obstruction at the side of the pool, and the necessary spacing from the edge necessitates a corresponding long support arm for the patient support member. This results in high cantilever loading when a patient is supported over the pool and this further accentuates the fixing problems.

It has been proposed that the column should be mounted within the pool at the side thereof, but these proposals have necessitated a heavy and strongly braced support frame structure with firm fixings to the decking and/or a support structure which rests on the decking and the floor of the pool so that it has to be dimensioned to suit the pool concerned and the mounting position.

SUMMARY OF THE INVENTION

The object of the invention is to provide a hoist support which can be used to mount a hoist with the column thereof within the pool, so that only a short support arm is required, which is of more universal application and which enables the hoist to be readily demountable for removal when not required.

According to one aspect of the invention a support structure of or for a hydrotherapy hoist or pool lift is adapted to engage an upper anchorage capable of withstanding horizontal loading at least in a direction towards the pool and has a reaction support engaging or engagable with the side wall of the pool, whereby the cantilever loading when a patient is supported over the pool is withstood by a couple provided by the horizontal loading and the reaction force at the side wall support.

Preferably the support structure is separate from the hoist in such manner that the latter can be lifted off the support structure when not required, the detachable mounting of the hoist conveniently allowing the latter to swing around as a whole about a vertical bearing axis. To enable the support to be mounted close to the side wall of the pool and for the hoist to swing around through an angle of about 180°, so that in the loading position the patient support member of the hoist can be at the side of the column remote from the pool, said bearing axis is preferably offset from the column axis. This is in a preferred embodiment readily achieved by having two spaced bearing mountings of pintle type.

The support structure may be of simple tubular construction and of light weight so that it is easily fitted and removed separately from the hoist. Thus it may comprise a generally U-shaped upper tubular portion which engages said anchorage and extends above the pool decking which thus takes the weight of the hoist, and a lower portion comprising a single length of tube welded to the intermediate limb of the upper portion and providing the side reaction support. With such a support structure a reaction pad to engage the side wall may be positioned adjacent the bottom of the lower portion with said pintle-type bearing mountings respectively positioned adjacent the upper and lower ends of the lower portion. These pintle-type bearings may for example be as used for the mounting of a yacht rudder, comprising bearing blocks with pivot bores mounted on the support structure and correspondingly spaced offset pivot pins mounted on the column of the hoist.

Alternatively, as said anchorage the support structure of the invention may utilise a handrail extending along the side wall, such handrails commonly being fitted in public swimming baths. In this case the support structure may be constructed with at least one attachment which hooks over such a handrail, two spaced attachments of this nature conveniently being used to provide stability for the support structure in the horizontal plane. Such an arrangement has the advantage that no special anchorage has to be provided and the support is easily lifted off the rail when not in use. The attachment to the handrail can be such that the latter also supports the weight of the hoist, but in general it is desirable that the rail should withstand only horizontal loading and the weight of the hoist be otherwise supported. This weight may be supported by an upper portion of the support structure resting on the decking at the edge of the pool.

Although the support structure may comprise a readily fitted and removable support frame arrangement, either engaging an anchorage provided on the pool decking or the pool handrail as has been described, it may alternatively utilise structure already present in the pool. This is a particular advantage when the hoist is used at a public swimming pool as the support structure may then be a normal access ladder to one side stile of which a bearing mounting or mounting for the hoist can be permanently fixed. When the hoist is removed such adaption of the access ladder to provide a support structure in accordance with the invention does not present any additional effective obstruction within the pool.

The invention, according to another aspect thereof, also comprises the combination of a hydrotherapy hoist or pool lift and a support structure therefor which withstands the cantilever loading of a patient suspended above the pool by a couple consisting of horizontal loading of an upper anchorage and a lower reaction force at a reaction support on the side wall of the pool, the support providing a bearing mounting or mountings for an upstanding column of the hoist such that the latter can readily be lifted off the support structure when not required.

As the column is supported within the pool itself only a short support arm is required with the patient support member positioned close to the column, thereby keeping to a minimum the cantilever loading withstood by the said couple. Thus only a very light anchorage is required. Locking means may be provided to lock the column of the hoist against turning whilst a patient is being transferred between a wheelchair and the patient support member of the hoist. When the support structure has an upper portion which extends over the decking that portion can be sufficiently short in extent so as not to obstruct movement of a wheelchair to a position directly alongside the support member when the latter is in the loading position.

The patient support member may be an integral part of the hoist in the sense that it is permanently secured to the support arm projecting from the column. However, it can equally well be secured to the support arm in a detachable manner and the patient can then be transported to the hoist on the support member. In this case the latter may be mounted on a wheeled chassis from which it is removable when it has been secured to the support arm, or the support member may comprise a wheelchair construction which is attached to the arm and lifted as a whole with a patient and lowered into the pool.

Other features of the invention will be apparent from the following description, drawings and claims, the scope of the invention not being limited to the drawings themselves as the drawings are only for the purpose of illustrating ways in which the principles of the invention can be applied. Other embodiments of the invention utilising the same or equivalent principles may be used and structural changes may be made as desired by those skilled in the art without departing from the present invention and the purview of the appended claims.

DESCRIPTION OF THE PREFERRED EMBODIMENTS

Figure 1:
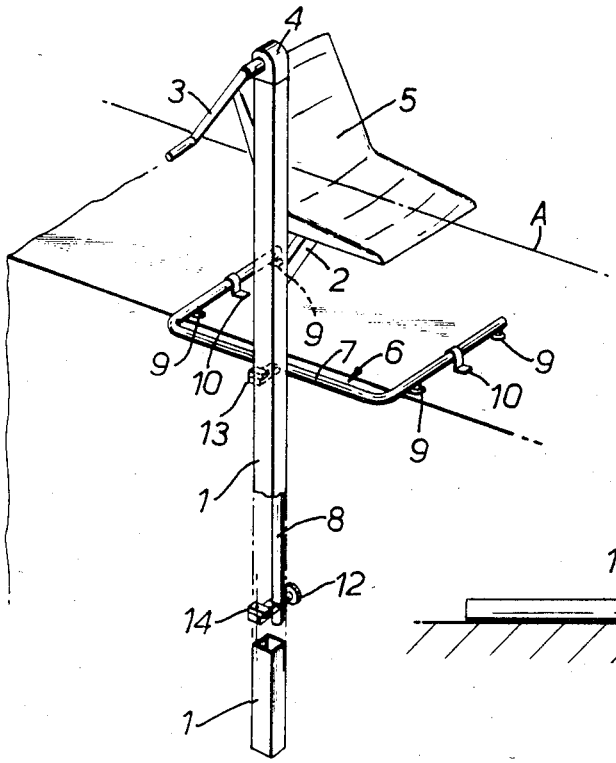
FIG. 1 is a diagrammatic perspective view illustrating a hoist mounted on a support structure in accordance with the invention.

Referring to FIG. 1, the hoist comprises a vertical lifting column 1 of rectangular steel section with a longitudinal slot in one side wall from which a short cantilever support arm 2 projects. A lifting mechanism (not visible) within the column comprises a carriage to which the arm is attached and this mechanism is operated by a top winding handle 3 through a gear box 4. A patient support member 5, comprising seat and back portions, is supported on the outer end of the arm 2 beneath the seat and secured to the arm.

A support structure 6 constructed from tubular steel comprises a U-shaped upper portion 7 which extends over the decking at the side edge of the pool and a lower portion 8, which comprises a single length of steel tube welded to the intermediate limb of the upper U and which extends down into the pool. The side limbs of the upper U portion 7 have support pads 9 which rest on the decking and these limbs engage below suitable anchorages 10 such that the pads 9 are held firmly in engagement with the decking. At the lower end the tube portion 8 has a reaction pad 12 which bears against the side wall of the pool. The hoist is supported in spaced pintle-type bearing mountings at 13 and 14 on the lower tube portion 8, with offset bearing pins fixed to one side of the column 1 engaging bearing blocks respectively welded to the portion 8 adjacent the upper and lower ends thereof. With this arrangement the hoist can be lifted off the bearing mountings 13,14 after use and the support structure 6 is also readily and separately removable when not required.

Manually-operable locking means are provided (not shown) which enable the hoist to be locked in the position illustrated with the fore-and-aft axis A of the seat support 5 parallel to the edge of the pool. With the hoist so locked a wheelchair can be brought alongside the support 5 for transfer of the patient the edge of the seat overhanging the upper support portion 7 so that the latter does not impede wheelchair movement. When the locking means are freed the hoist as a whole, with the patient, can be swung around on the bearings 13 and 14 through a full 180°, about a vertical bearing axis offset from the column axis to one side of the column 1, so that the patient can be lowered into the water for treatment with the axis A again parallel to the edge of the pool but reversed.

Figure 2:
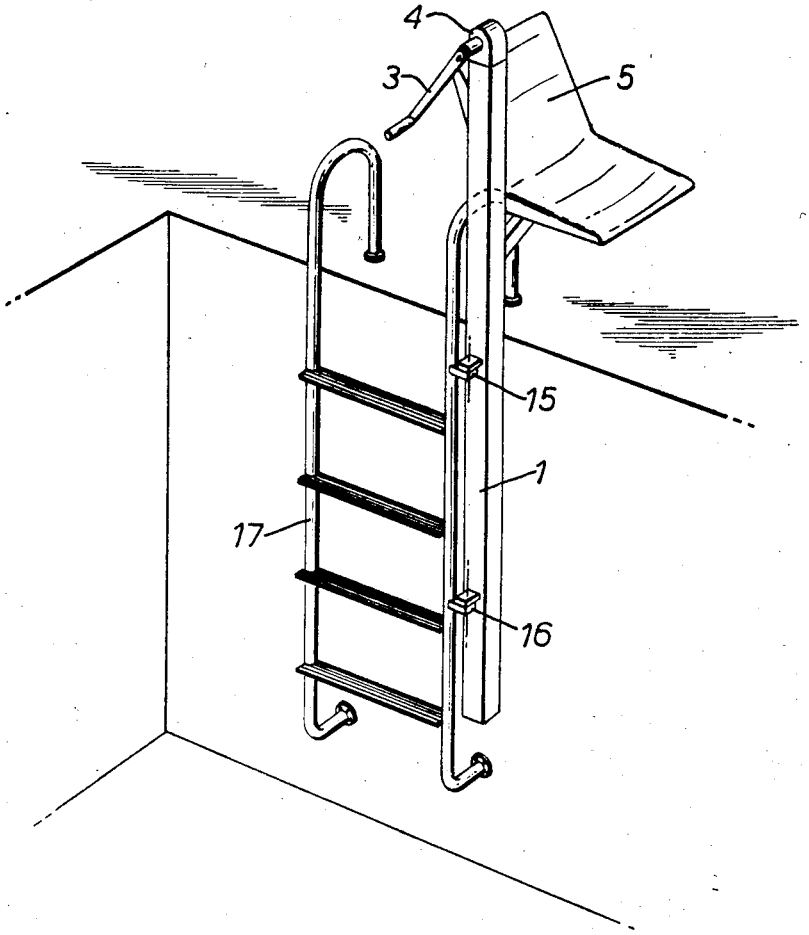
FIG. 2 is a similar view showing the hoist mounted on the side of a pool access ladder.

FIG. 2 illustrates how the support structure may comprise a conventional pool access ladder 17 when such is already fitted to the pool. The only adaption of the ladder 17 required to provide a support structure in accordance with the invention being the fitting of the pintle-type bearing blocks at 15 and 16 on one side stile of the ladder.

Figure 3:
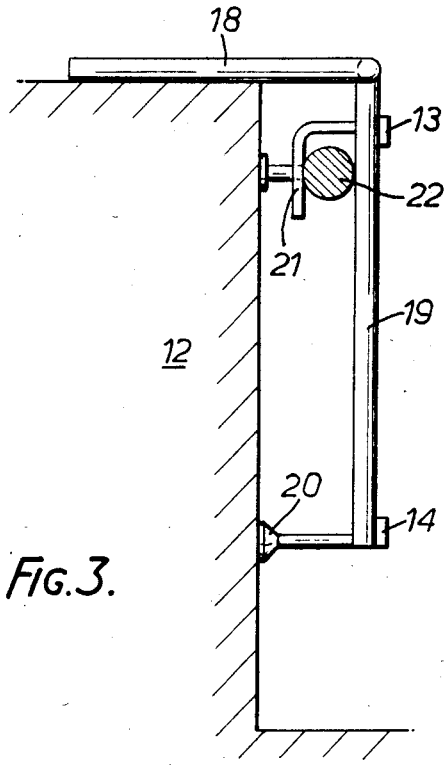
FIG. 3 shows another support structure in accordance with the invention.

FIG. 3 shows a support structure generally similar to that of FIG. 1 utilising a handrail within the pool as the upper anchorage which withstands horizontal loading of the support structure, so that no anchorage on the pool decking is required. The support structure has an upper portion 18 which rests on the decking alongside the pool edge to support the weight loading of the structure, and a lower portion 19 carrying at its lower end a reaction pad 20 which engages the side wall as before. To provide the anchorage an attachment 21 on the portion 19 in effect hooks over the rail 22 which thus withstands horizontal loading of the hoist with no weight loading being applied to the rail 22. The pintle bearing blocks 13 and 14 are attached to the support portion 19 as before.

The construction of FIGS. 4 to 8, illustrated in schematic outline in these Figs., differs from that of FIG. 1 mainly in that the support pads 9 are omitted. Thus the support structure 30 of this construction has a U-shaped steel tubular upper portion 31 which extends directly above the pool decking and in this case the ends of the side limbs 31*a* of the U hook under anchor T-bolts 32 as will later be described in more detail. A single length of tube bent into a U-shape provides the vertical lower portion 33 of the structure 30 and carries at its lower end a reaction pad 34 which engages the side wall 35 of the pool. Instead of the U-shaped tubular portion 33 this portion may comprise a single length of larger diameter tube as in the arrangement of FIG. 1, providing a somewhat simpler construction.

A symmetrical support structure 30 may be employed with the lower portion 33 welded centrally to the intermediate limb 31*b* of the upper U portion 31. However, as seen in the plan view of FIG. 4 the left-hand end of the upper portion 31 may be foreshortened, with the corresponding side limb moved inwards as indicated at 31*a*. This provides a lighter and smaller support structure, and takes account of the fact that with the seating arrangement illustrated the greater weight and cantilever loading of the structure is at the right-hand side in FIG. 5.

Figure 4:
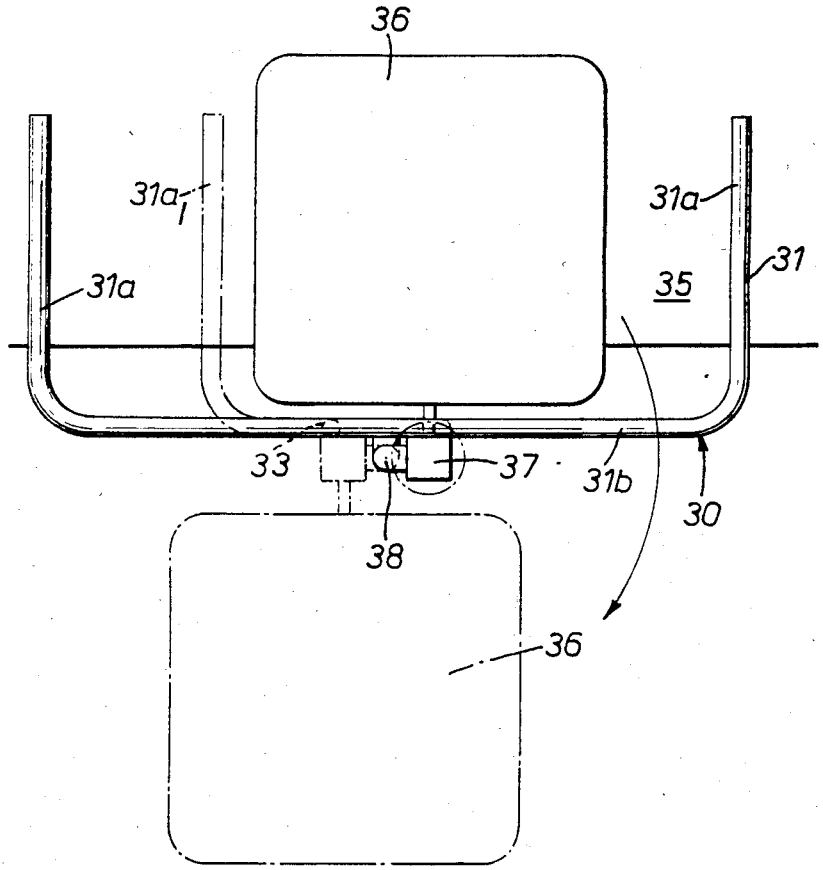
FIG. 4 shows in plan view an alternative support structure similar to that of FIG. 1.
Figure 5:
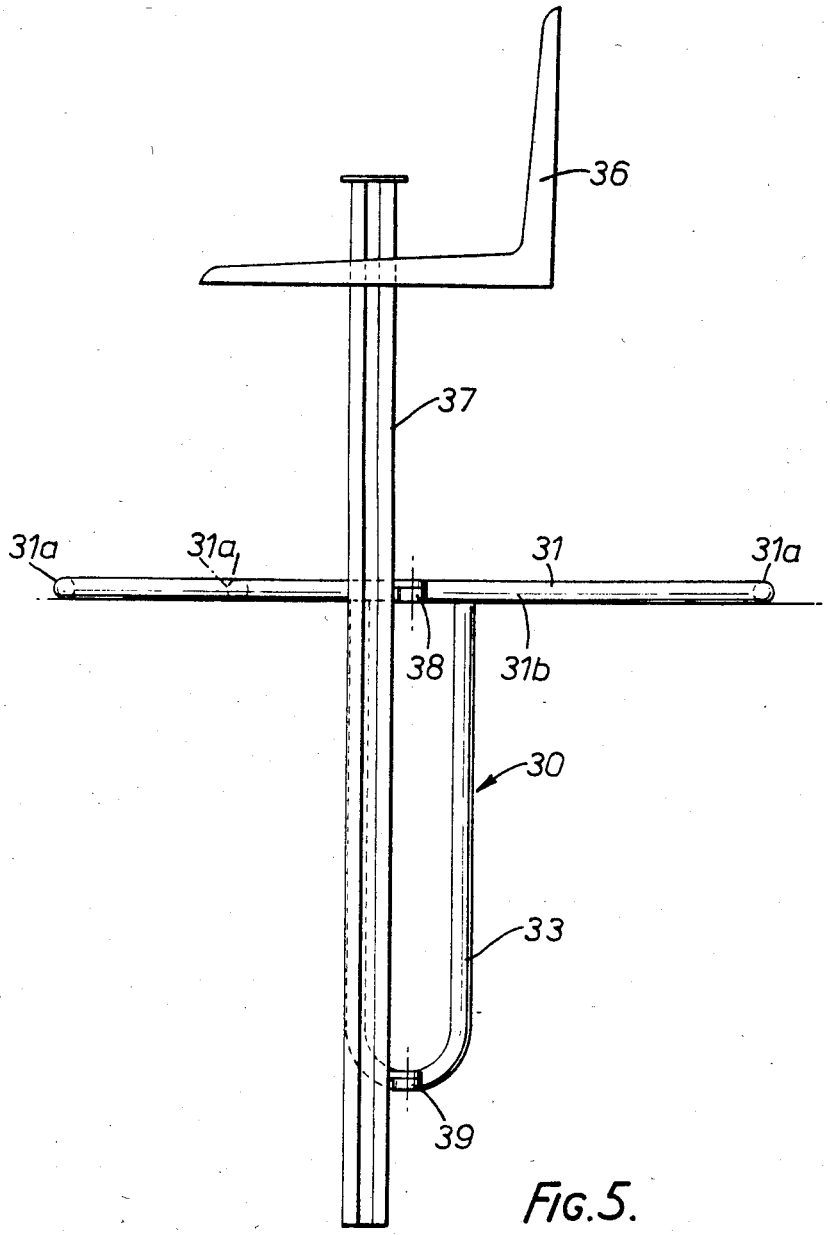
FIG. 5 is a corresponding elevational view looking towards the side of the pool at which the hoist is mounted.
Figure 6:
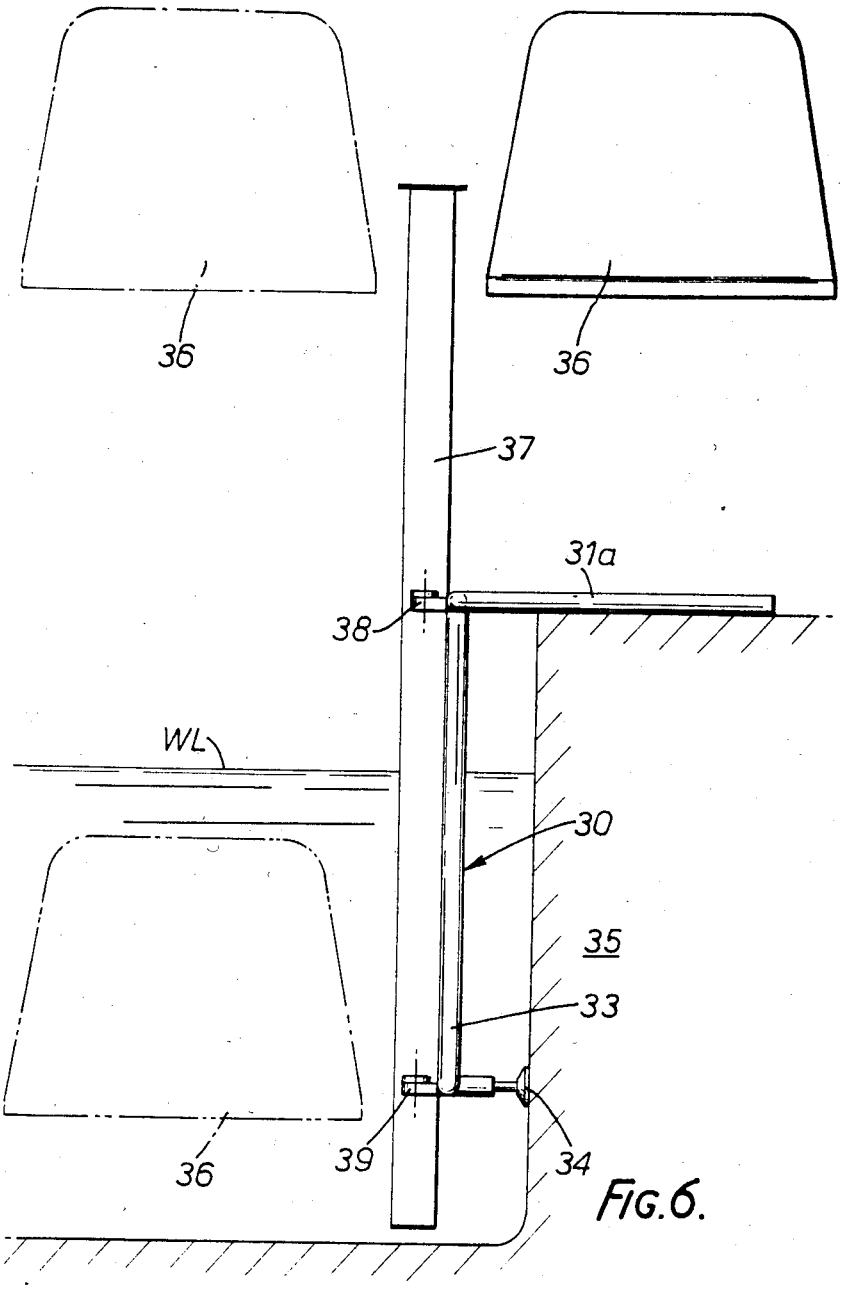
FIG. 6 is a side view looking along that side of the pool.

As previously mentioned FIGS. 4 to 6 show a schematic outline view of a practical construction basically similar to that of FIG. 1, with a seat-type patient support member 36 shown at the two limits of the angular movement of the column 37 in FIG. 4. The gear box is omitted from the top of the column in these figures, and the support member 36 is shown in FIG. 5 in the raised patient-loading position at the side of the pool. It is also shown in this position in FIG. 6 and, additionally therein, in raised and lowered positions above the pool and within the pool respectively, the water level in the pool being indicated by the reference WL. The pintle-type bearings are mounted at the top of the lower support portion 33 at 38, and at the bottom of that portion at 39, respectively.

Figure 7:
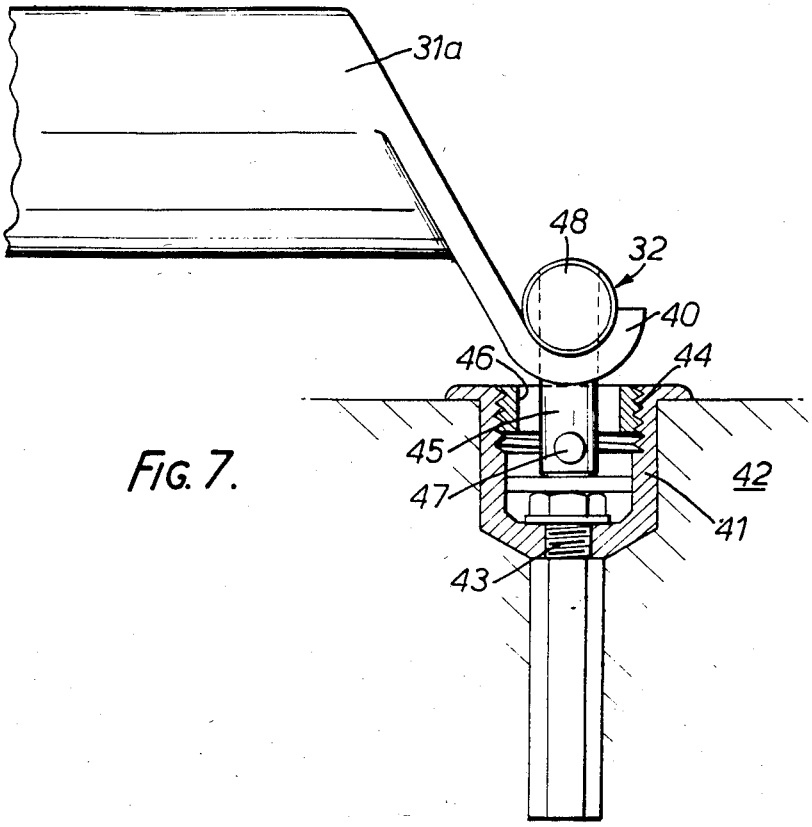
FIGS. 7 and 8 are detail views of anchorages suitable for this arrangement.
Figure 8:
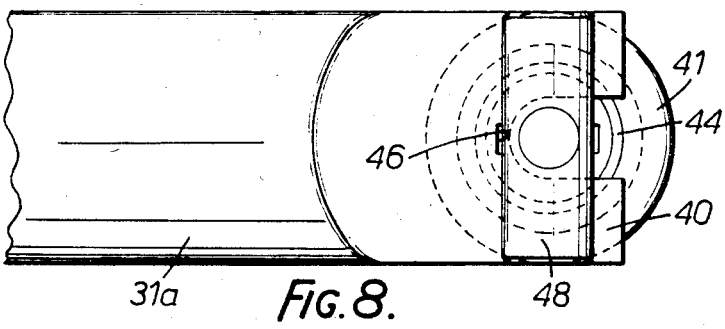

Referring to FIGS. 7 and 8, the features of which are omitted from FIGS. 4 to 6, each side limb 31*a* terminates in a forked and hook-shaped end portion 40 which hooks below the corresponding T-anchor bolt 32. The related anchorage comprises an internally threaded socket 41 which is let into the decking 42 and retained therein by a central bolt 43, such as on expandable anchor bolt fixing. A ring 44 firmly screwed into the socket 41 has a central through bore which receives a shank 45 of the related anchor bolt 32, and a diametral cross slot 46, which extends perpendicularly, to the edge of the pool. The anchor bolt 32 has a retaining cross pin 47, adjacent its lower end, and a T head 48 of circular section which fits the curved shaped of the corresponding end portion 40.

With the support structure 30 and the anchor bolts 32 removed the sockets 41, as will be appreciated, provide substantially no obstruction at the side of the pool. To fit the support structure 30 each anchor bolt 32 is first fitted, the retaining pin 47 thereof being aligned with and passed through the corresponding cross slot 46, whereupon the bolt 32 is turned through 90° so that it is retained below the related ring 44 with the bolt head 48 extending parallel to the edge of the pool. The end portions 40 of the upper side limbs 31*a* of the support structure can now be hooked around the bolt shanks 45 and below the bolt heads 48, thereby anchoring the support structure 30 in operative position at the edge of the pool. No other fixing of the support structure is required, this structure being supported only at the two anchorages and at the side wall of the pool where the latter is engaged by the reaction pad 34.

I claim:

1. A hydrotherapy hoist including an upstanding support column and a patient support member supported by said column, and a support structure by which the hoist is supported on the decking at the edge of a pool with the column extending downwardly into the pool, wherein the support structure comprises:

an upper portion adapted to extend over the decking to support the vertical weight of the hoist on the decking, and adapted to engage an anchorage capable of withstanding horizontal loading at least in a direction towards the pool;

a lower portion having a reaction support for engagement with the side wall of the pool whereby the cantilever loading when a patient is supported on the hoist above the pool is withstood by a couple provided by the reaction to said horizontal loading applied to the anchorage and by the reaction force at said reaction support; and support bearings for the upstanding support column which allow the latter to swing about a vertical axis offset from the longitudinal axis of the column between an operative position with the patient support member positioned above the pool to a loading position above the decking alongside the pool, said operative position and said loading position being displaced from one another by 180°, and wherein in the loading position the center of gravity of the hoist with a supported patient being positioned above said upper portion of the support structure so that the hoist is supported in a stable manner by the upper portion of the support structure resting on the decking.

2. The support structure according to claim 1, wherein said support structure further comprises means for detachably mounting the hoist, the detachable mounting allowing the hoist to be lifted off said support structure when not in use.

3. The support structure according to claim 1, wherein said support bearings comprise two vertically-spaced, pintle-type bearing mountings.

4. The support structure according to claim 1, wherein said support structure is of tubular metal construction and wherein said upper portion is generally U-shaped and is disposable above the deck at the edge of the pool so that the weight of the hoist is capable of being applied directly to the deck.

5. The support structure according to claim 4, wherein said U-shaped upper portion has an intermediate central limb, and two side limbs joined to opposite ends thereof, wherein said lower portion comprises a single length of tube fixed to said intermediate limb of said upper portion, and wherein said reaction support comprises a reaction pad for engagement with the side-wall of the pool which pad is positioned adjacent to a lower end of said lower portion.

6. The support structure according to claim 5, wherein said lower portion is fixed to said intermediate limb of said upper portion closer to one side limb of said upper portion than to the other side limb thereof.

7. The support structure according to claim 4, additionally comprising a fixed anchorage composed of T-headed anchor bolts securable to the deck and wherein said side limbs of said upper portion are provided with forked end portions which serve as said anchorage means and are receivable in a hook-line manner under said T-headed anchor bolts.

8. The support structure according to claim 1, additionally comprising a fixed anchorage composed of a hand rail securable along the sidewall of the pool and wherein said support structure includes at least one attachment which serves as said anchorage means and is configured to hook over said handrail, said attachment being configured so that said handrail is not subject to any appreciable vertical loading.

9. The support structure according to claim 8, wherein said upper portion of said support structure is configured to rest on the deck at the edge of the pool whereby the loading weight of the hoist may be directly withstood by the deck.

* * * * *